US005504344A

United States Patent [19]

Stein et al.

[11] Patent Number: 5,504,344

[45] Date of Patent: Apr. 2, 1996

[54] RADIATION SHIELD

[75] Inventors: Martin H. Stein; Russell N. Stein, both of Andover, N.J.

[73] Assignee: **Gray*Star, Inc.**, Mt. Arlington, N.J.

[21] Appl. No.: 280,449

[22] Filed: Jul. 26, 1994

[51] Int. Cl.[6] ..... G21F 5/04

[52] U.S. Cl. ..... 250/515.1; 250/496.1

[58] Field of Search ..... 250/515.1, 506.1, 250/517.1, 518.1, 519.1, 496.1

[56] References Cited

U.S. PATENT DOCUMENTS 3,584,217 6/1971 Woodburn ..... 250/496.1
3,936,340 2/1976 Muehllehner ..... 250/515.1
4,033,885 7/1977 Stone et al. ..... 250/496.1
4,124,804 11/1978 Mirell ..... 250/496.1

*Primary Examiner*—Jack I. Berman
*Assistant Examiner*—Kiet T. Nguyen
*Attorney, Agent, or Firm*—Dennison, Meserole, Pollack & Scheiner

[57] ABSTRACT

In a radiation shield between joinder surfaces to preclude a radiation path therethrough, a series of alternating complemental ridges and valleys on each surface. The ridges and valleys on each surface are in turn interdigitated with the complementary ridges and valleys on the second surface and of a height and depth sufficient to preclude the lateral free movement of radiation flux.

11 Claims, 6 Drawing Sheets

RADIATION SHIELD

BACKGROUND OF THE INVENTION

Radiation source containers, such as contained irradiators, shipping casks and the like that contain radioactive material, such as cesium-137 or cobalt-60, are subject to a difficult design problem. Most of these devices are constructed of steel and/or lead, and although components can be fabricated with some degree of precision, it is still necessary to have components that move relative to each other, for example a movable or removable closure system for the radiation source container. In such instances, it is desirable or necessary to provide fairly large tolerances to accommodate considerable expansion and contraction, and to avoid a "tight fit" to facilitate assembly, in many cases by robotic equipment. This in turn results in cracks or gaps between adjacent faces on adjoining components. Radiation from the sources will "stream" through these cracks escaping from the unit, unless means are employed to prevent such escape.

The most obvious manner of attempting to reduce radiation escape is to keep the gap between the components as small as possible. This approach is limited by the possibility that the components may collide and cause binding. This binding or jamming can in turn require that the unit be repaired, usually remotely in a hot cell or water pool, which is both inconvenient and quite expensive. Therefore, the designer will want to keep the component interface distance as large as possible and yet meet the radiation integrity requirements.

The most commonly used manner of preventing radiation streaming is by the use of "steps," as illustrated in prior art FIG. 3. Gamma photons travel in straight lines and, unlike visible light photons, there is very little reflection off surfaces on impact. A typical reflection albedo is in the range of 1%. The use of stepped gaps or passages, whether angular as in FIG. 3 or arcuate as in prior art FIG. 4, is very effective in reducing streaming. The steps are set perpendicular to the direction of photon travel, and on impact, most of the photons are absorbed by the material of the encountered surfaces where they are converted to low grade heat. The rest of the photons scatter. A small percentage are "reflected" and stream on through the gap until they impact the second turn in the step and the process is repeated. This traps even more photons. The curved joinder of FIG. 4 functions in basically the same manner.

While the stepped shield is very effective, it is not usually in itself sufficient. For example, it is sometimes necessary to reduce radiation levels from the inside of an irradiation chamber to the outside by a factor of more than a billion. Multiple steps are helpful, but present additional design problems, and can complicate assembly. Further, as schematically suggested in FIG. 5 at A, the laterally angling random radiation flux is substantially unimpeded between the opposed planar faces.

Other approaches have been proposed, such as filling the gaps with mercury, thus forming a continuous high density fluid shield between components. However, mercury vapor is toxic, and an inadvertent leak of this fluid would breach shield integrity. This could occur by simply turning a portable radiation source container, such as a cask, upside down.

SUMMARY OF THE INVENTION

The present invention is concerned with the reduction of isotropic radiation streaming in a plane defined between two adjacent surfaces to a degree substantially beyond that heretofore considered possible. This is achieved by essentially preventing the photons which are other than collimated from moving at angles between the surfaces from the radiation source to the exterior. This is accomplished by "ridging" the two adjacent surfaces and "interlocking" or "interdigitating" the ridged surfaces.

The ridging is effected by providing each surface with alternating ridges and valleys of complimentary configurations and extending in the longitudinal direction of the flow of photons outward from the radiation source. The height and depth of the ridges and valleys are such as to allow for substantial interdigitating of the surfaces with each other whereby, even assuming substantial tolerances or gaps to accommodate expansion and contraction and trouble-free relative movement, there is a substantial barrier to lateral flow of photons and a resultant substantial increase in the photon absorption effectiveness.

The photon absorption effectiveness of the shield formed by the interdigitated surfaces will vary with the specific surface design, that is the configuration of the ridges and valleys, whether sharply peaked, rectangular, semi-circular, parabolic, or the like. Other obvious variables will include the actual width of the gap between the interdigitating surfaces, the nature of the materials and the collimation length, that is the distance of photon travel along the shield components or surfaces.

As desired the ridged configuration can be combined with the prior art stepping as a further means for enhancing the effectiveness of the formed barrier. As an order of magnitude estimate for the effectiveness of the radiation shield of the invention, it is contemplated that a typical reduction of radiation streaming be by a factor of 1,000.

Additional objects, features and advantages of the invention will become apparent as the details of the invention are more fully hereinafter presented

BRIEF DESCRIPTIONS OF THE DRAWINGS

Figure 12:
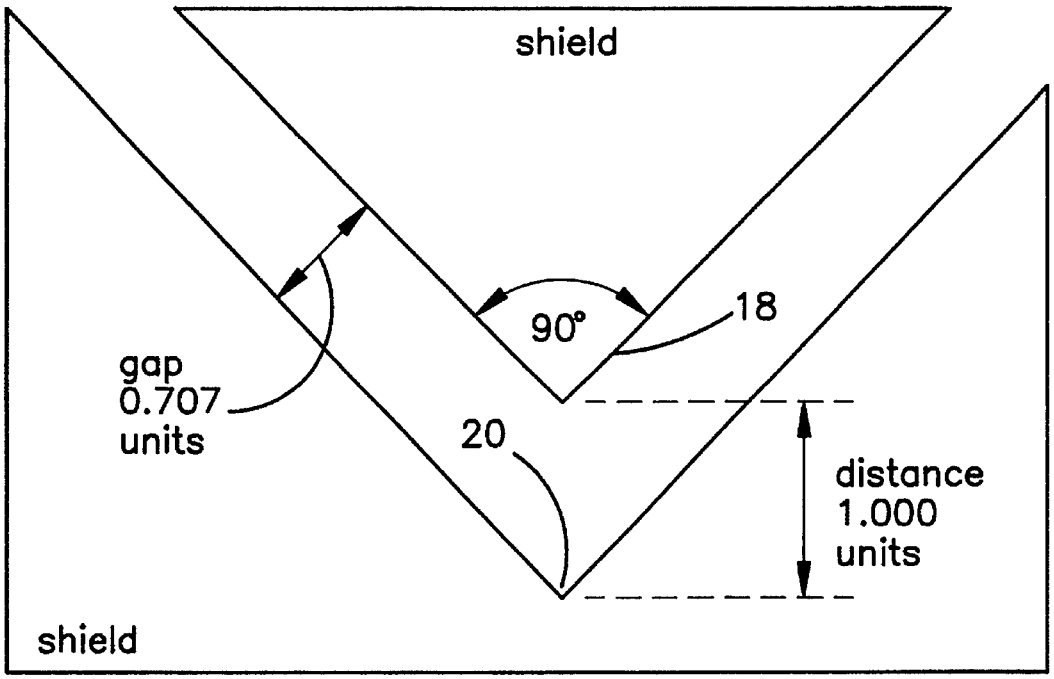
Figure 13:
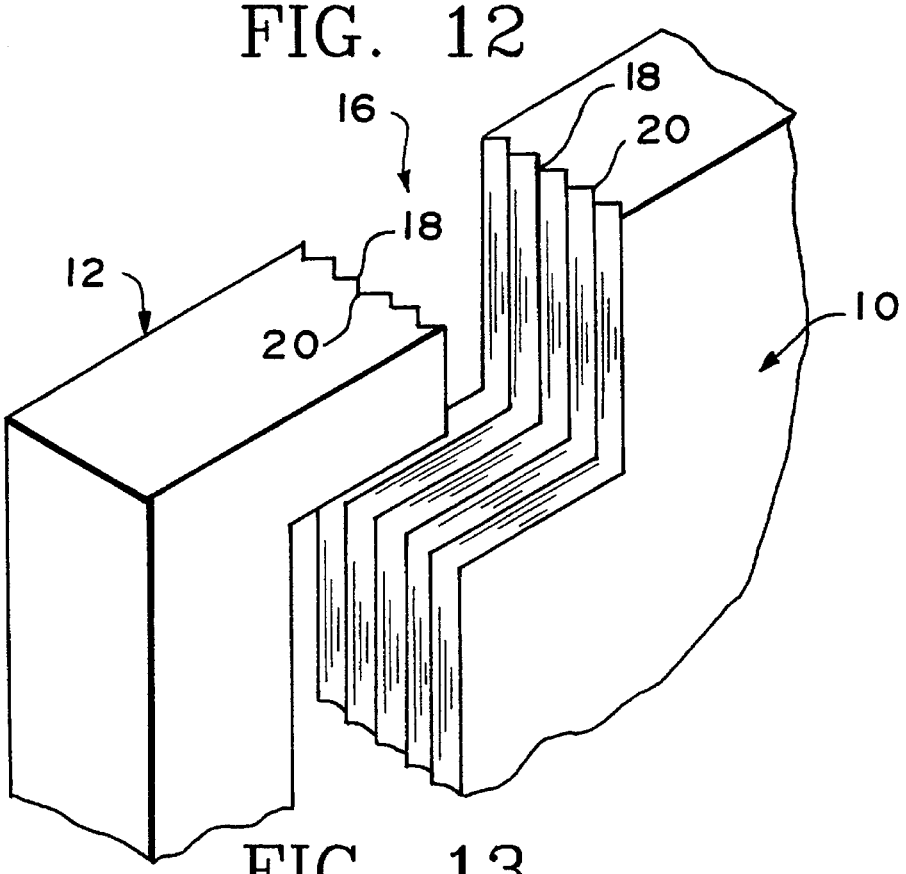

FIG. 12 schematically illustrates a particularly advantageous ridge and valley relationship; and FIG. 13 is a schematic illustration of a radiation streaming reduction system between adjacent walls of a radiation source container and a closure component and wherein a stepped system is combined with the alternating ridges and valleys of the shield system of the present invention.

DESCRIPTION OF PREFERRED EMBODIMENTS

Figure 1:
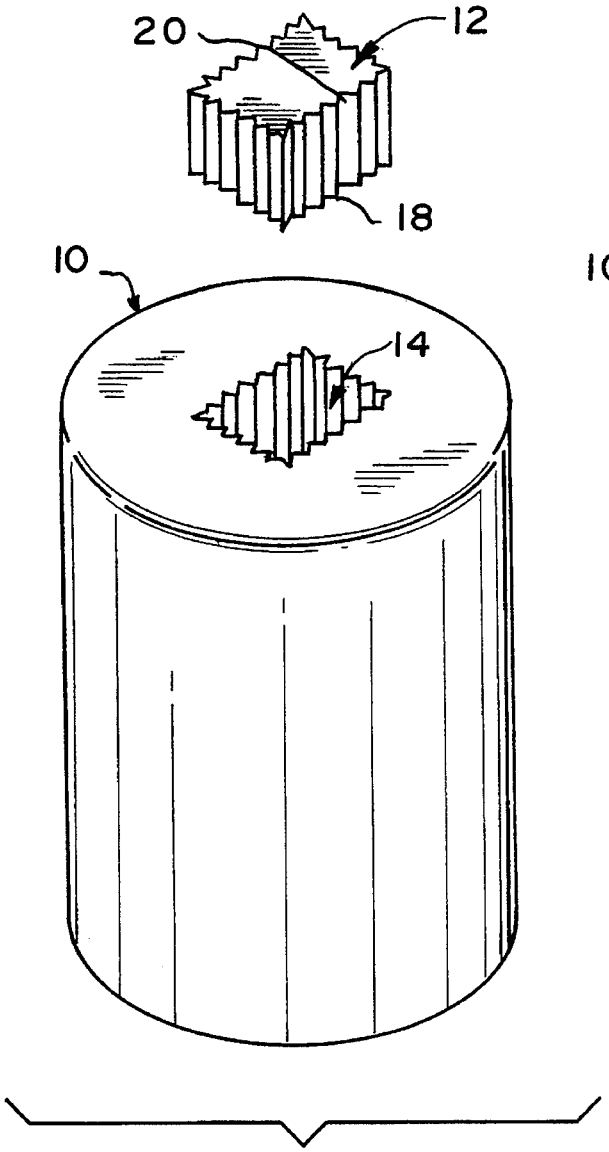
FIG. 1 is a schematic illustration of a container or containment vessel for a radiation source such as radioactive material, with a component, for example a closure, outwardly positioned relative to a port within the container.
Figure 2:
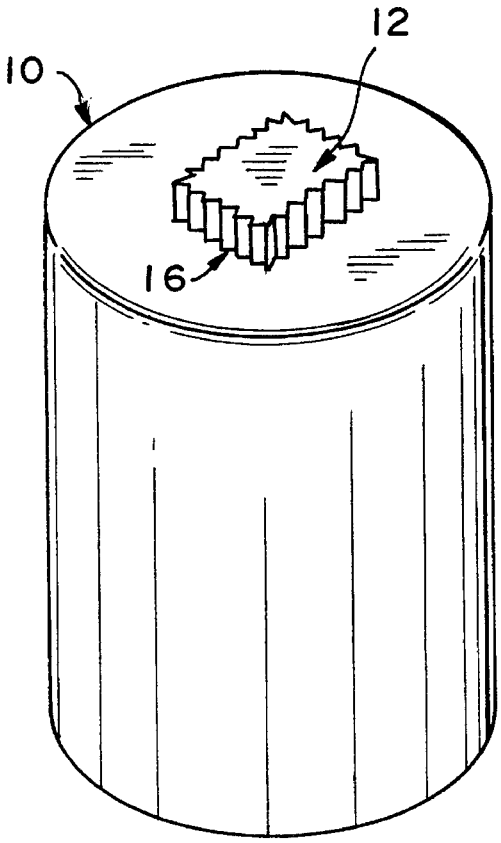
FIG. 2 is a perspective view with the closure component partially received within the containment vessel port for a sealing thereof with substantial reduction of photon streaming.

Referring now more specifically to the drawings, FIGS. 1 and 2 are intended to schematically represent a typical radiation source containment vessel or container 10 and a closure or sealing unit 12 for an access opening or port 14 within the container 10. As will be recognized, the closure, particularly in the larger more bulky assemblies, must be readily assembled to, and removed from, the container 10 by remote and/or robotic means without binding or jamming. This, particularly when considering what might be substantial expansion and contraction of the two components 10 and 12, necessitates what, with regard to radiation flow, comprises a substantial gap between the peripheral walls of the container and closure. The radiation shield 16 of the invention reduces radiation streaming from the generated isotropic radiation flux of a source within the container 10 to a degree substantially beyond what has heretofore been achieved by conventional shield member interface configurations.

The radiation shield 16 of the invention restricts, and in fact prevents laterally dispersed or angled photon flow from the radiation source outwardly through the gap, and limits the flow to only those photons which are collimated. This is achieved by providing each of the surfaces defined by the peripheral wall of the port 14 and the peripheral wall of the closure 12 with a series of alternating ridges 18 and grooves or valleys 20 uniformly configured for a complementary and mating engagement of the port wall surface with the closure wall surface. As suggested in the drawings, the respective heights and depths of the ridges and valleys are such as to provide for a substantial interdigitation or mating interlock whereby no unimpeded lateral, i.e., non-collimated photon, flow within the formed gap is possible, notwithstanding substantial gap tolerances and variations thereof due to expansion and contraction as required by the nature of the components.

Figure 7:
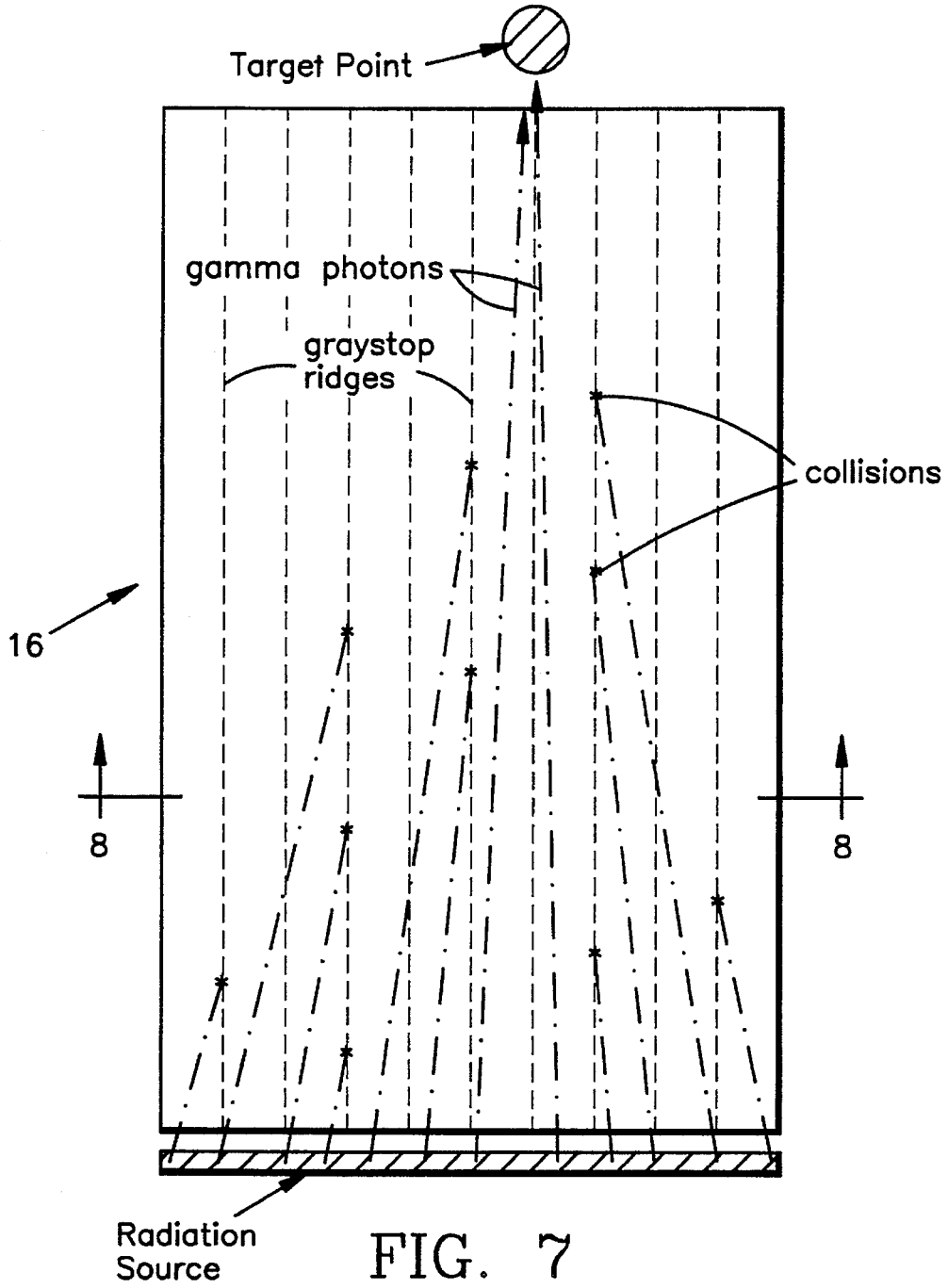
FIG. 7 is a schematic illustration, similar to the prior art schematic showing of FIG. 5, and illustrating the effectiveness of the alternating ridges and valleys of the shield system of the present invention as a radiation absorption system.
Figure 8:
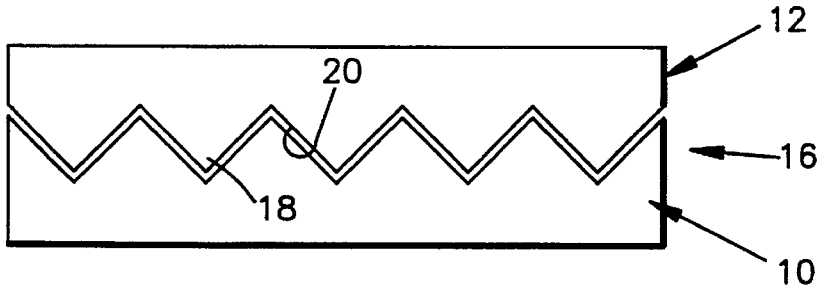
FIG. 8 is a cross-sectional detail of the shield of FIG. 7 taken on a plane passing along lines 8—8 in FIG. 7.
Figure 9:
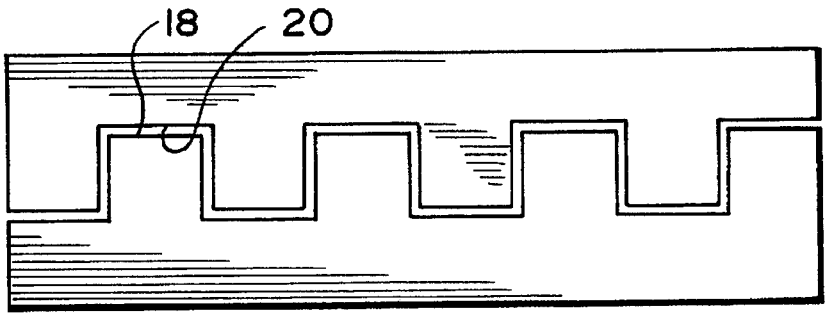
FIG. 9 illustrates an alternate ridge and valley arrangement.
Figure 10:
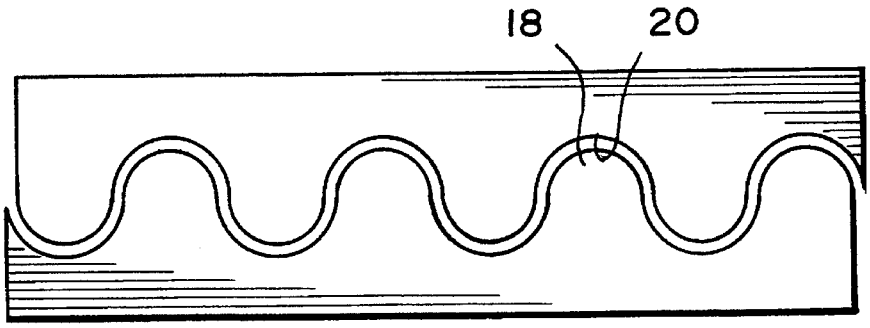
FIG. 10 illustrates a further alternate ridge and valley arrangement.
Figure 11:
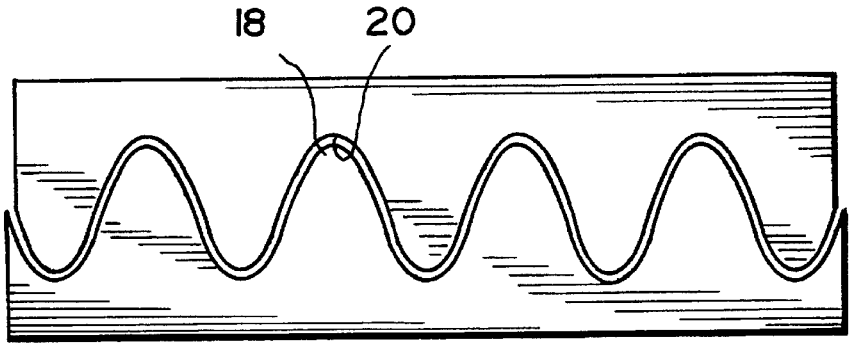
FIG. 11 illustrates an additional ridge and valley arrangement.

The relationship between the interdigitated surfaces will be readily apparent from the enlarged cross-sectional details of the principal trigonal interface of FIGS. 7 and 8 and the alternate configurations of FIGS. 9, 10 and 11 which respectively illustrate a rectangular interface, a circular interface and a parabolic interface.

Figure 5:
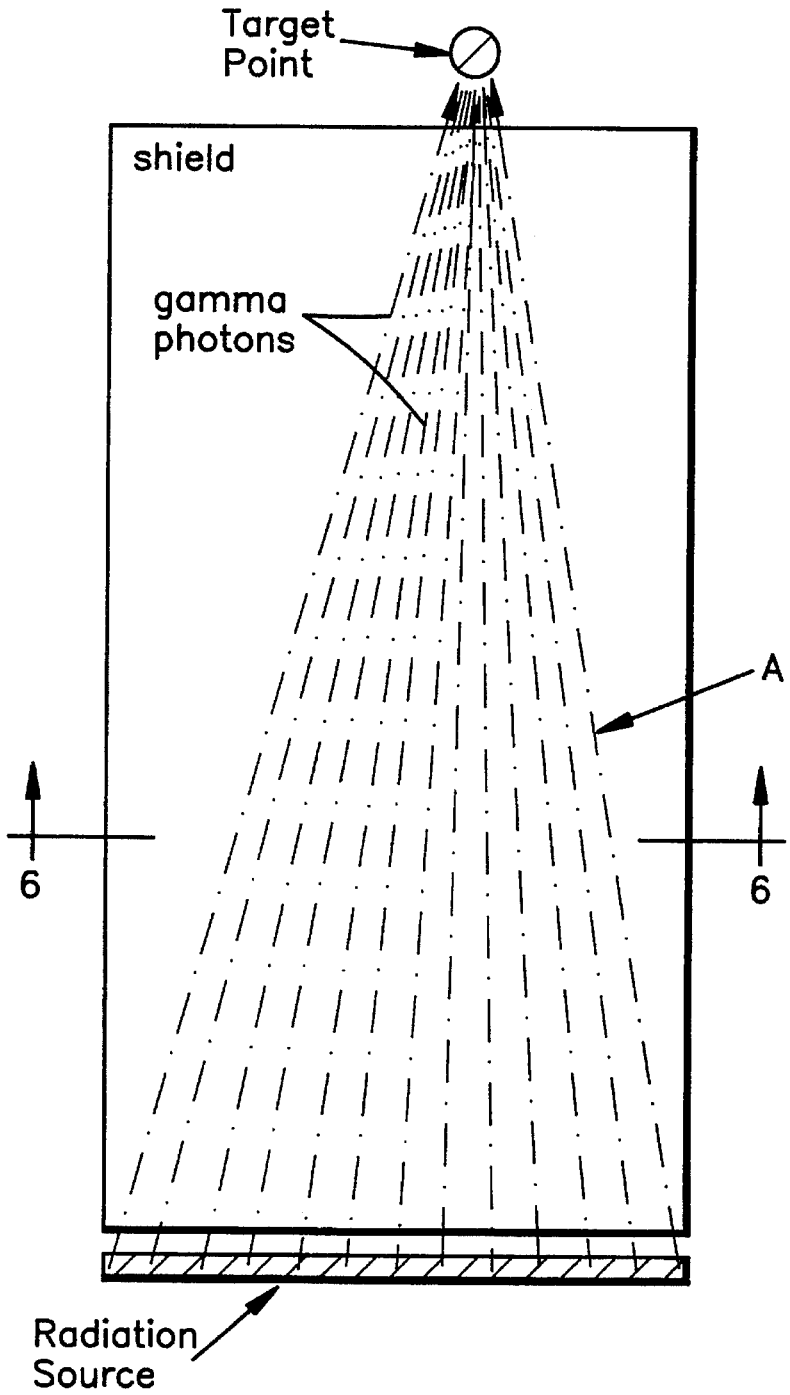
FIG. 5 PRIOR ART
FIG. 5 is a schematic illustration of the angular random substantially unimpeded radiation flux flow between prior art shield elements having opposed planar surfaces.
Figure 6:
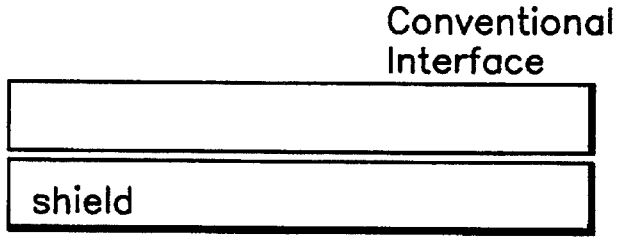
FIG. 6 PRIOR ART
FIG. 6 is a cross-sectional detail of the shield taken on a plane passing along lines 6—6 in prior art FIG. 5.

As previously indicated, FIG. 5 schematically illustrates the unimpeded photon flow between opposed planar surfaces of a conventional shield interface. In contrast, the schematic illustration of the radiation shield 16 of the invention, as illustrated in FIG. 7, clearly demonstrates the effectiveness of the shield wherein photons other than those few specifically collimated relative to the ridges 18 and valleys 20, will encounter immediately adjacent ridges for collision with and absorption by the material, e.g., steel, of the ridges and valleys at the point of engagement therewith before reaching the target point. Due to minimal reflection of photons, e.g., an albedo in the order of 1%, and continued collision and absorption, the streaming of photons outwardly of the source container will be substantially eliminated. With continued reference to the schematic illustration of FIG. 7, it will be appreciated that the greater the length of the radiation shield in the direction from a radiation source in the container to ambient, the greater the likelihood of collision with and thus absorption of photons within the ridges with corresponding reduction of streaming by any photons other than those exactly collimated or paralleling the interdigitated ridges and valleys.

Figure 3:
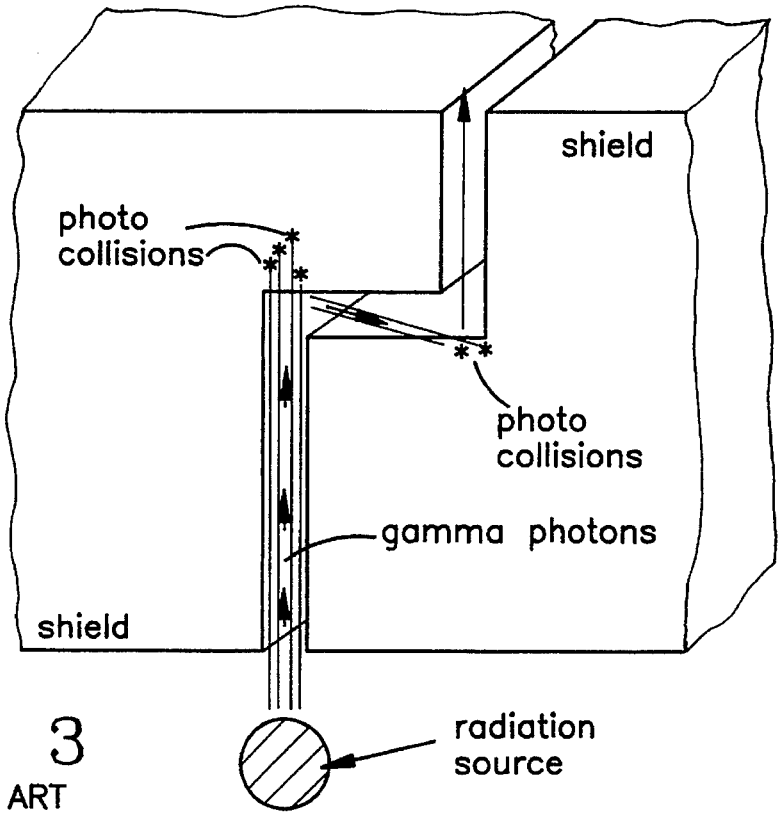
FIG. 3 PRIOR ART
FIG. 3 is a cross-sectional detail through a prior art stepped radiation streaming reduction system between adjacent walls of a radiation source container and a closure component.
Figure 4:
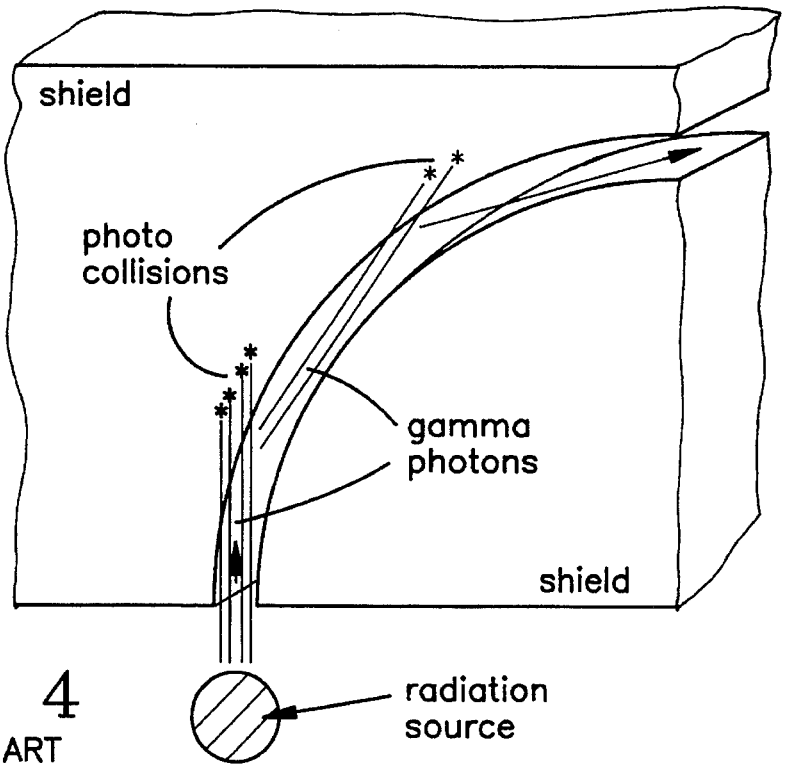
FIG. 4 PRIOR ART
FIG. 4 is a cross-sectional detail illustrating a prior art variation of the stepped system of FIG. 3.

Referring again to the exemplary embodiment of FIG. 2 with respect to a containing vessel 10, it will be recognized that the parallel ridges and valleys of the radiation shield 16, extending parallel to the direction of movement of the closure 12 relative to the containing vessel 10, allow for a smooth unimpeded engagement of the closure and subsequent removal of the closure. As desired, appropriate locating means, stops or the like can be provided to define or limit inward travel of the closure within the containing vessel. For example, a prior art stepped shield, as in FIG. 3, can be used in conjunction with the radiation shield of the invention both to provide a locating means and to even further enhance the efficiency of the shielding effect. In such a combination of shield configurations, as suggested in FIG. 13, it will be appreciated that the ridge and valley shield of the invention will be defined between all opposed parallel faces of the container and closure surfaces.

Referring to FIG. 12, the triagonal interface therein has been illustrated with ridge and valley angles of 90 degrees. This particular geometry results in a situation where the gap between the shield surfaces is only 70.7% of the "tolerance" distance between shield sections. This means that the tolerance difference between sections can be 41.4% greater than the gap set. This is an important advantage as one wants to reduce the gap as much as possible to restrict the radiation streaming, while at the same time increase the tolerance distance as much as possible to accommodate changes such as the thermal expansion of the components, and also to compensate for manufacturing intolerances. If the 90 degree angle is increased or decreased, this particular advantage will decline until the gap is equal to the tolerance distance.

From the foregoing, it will be recognized that a significant advance has been made with regard to radiation shielding within necessarily occurring joinder gaps. The enhanced photon absorption effectiveness, and thus anti-streaming characteristic, is achieved without interference with the ability of the components to be assembled and disassembled in the conventional manner, such normally being effected remotely in a secured environment, possibly by robotic means which necessitates a degree of tolerance between the components sufficient to avoid jamming or misalignment. The shield of the invention effectively eliminates radiation streaming other than that which is collimated or travelling strictly in a linear direction along the interdigitated ridges and valleys. When optionally combined with a stepped shield interface, as suggested in FIG. 13, the minuscule streaming of remaining collimated photon flow can itself be further reduced, if not in fact practically eliminated.

The foregoing described embodiments of the ridge and valley shield are illustrative of the invention. As other embodiments incorporating the inventive features may occur to those skilled in the art, the disclosed embodiments are not to be considered as a limitation on the scope of the invention.

We claim:

1. A radiation attenuating shield for reduction of radiation flux emanating from a radioactive radiation source, said radiation source being within a containment zone selectively sealed by a closure component, said closure component being movable from a non-sealing position to a sealing position, a gap being defined about said closure component in the sealing position thereof, said shield comprising means within said gap for allowing only collimated radiation to pass through said gap and for precluding free passage of angularly directed radiation flow.

2. The radiation attenuating shield of claim 1, wherein said containment zone is defined within a containment vessel having an opening therein defined by a surrounding vessel opening surface, said closure component engaging within said opening and having a component surface paralleling said vessel opening surface with said gap defined therebetween, said radiation shield being defined by said component surface and said vessel surface.

3. The radiation attenuating shield of claim 2, wherein said component surface and said vessel opening surface comprise alternating complementary ridges and grooves extending along a length of the gap and along the radiation path from the containment zone, said ridges and grooves being in interdigitated relation with each other when the closure component is in the sealing position and defining radiation absorbing and reflection barriers relative to isotropic radiation flux.

4. The radiation attenuating shield of claim 3, wherein said alternating ridges and grooves define a triagonal interface.

5. The radiation attenuating shield of claim 4, wherein said triagonal interface includes defined 90 degree angles in said complementary ridges and grooves.

6. In the combination of a containment vessel and a closure, said containment vessel having an opening defined by a surrounding vessel opening surface, said closure engaging with said opening and having a closure surface paralleling said vessel opening surface;

a radiation shield between said vessel opening surface and said closure surface with a gap therebetween, said gap having an inner end and an outer end, said shield comprising attenuating ridges and grooves defined on each of said vessel opening surface and said closure surface, and extending longitudinally between said inner end and said outer end, said ridges and grooves on each of said vessel opening surface and said closure surface interdigitating with the ridges and grooves on the other of said vessel opening surface and said closure surface.

7. In the combination of claim 6, wherein said gap includes, between said inner end and said outer end thereof, a laterally offset portion, said ridges and grooves extending along said laterally offset portion.

8. A radiation attenuating shield for reduction of radiation flux emanating from a radioactive radiation source, said radiation source being within a containment zone selectively sealed by a closure component, a gap being defined about said closure component in a sealing position thereof, said shield comprising means within said gap for allowing only collimated radiation to pass through said gap and for precluding free passage of angularly directed radiation flow;

wherein said containment zone is defined within a containment vessel having an opening therein defined by a surrounding vessel opening surface, said closure component engaging within said opening and having a component surface paralleling said vessel opening surface with said gap defined therebetween, said radiation shield being defined by said component surface and said vessel surface.

9. The radiation attenuating shield of claim 8, wherein said component surface and said vessel opening surface comprise alternating complementary ridges and grooves extending along a length of the gap and along the radiation path from the containment zone, said ridges and grooves being in interdigitated relation with each other when the closure component is in the sealing position and defining radiation absorbing and reflection barriers relative to isotropic radiation flux.

10. The radiation attenuating shield of claim 9, wherein said alternating ridges and grooves define a triagonal interface.

11. The radiation attenuating shield of claim 10, wherein said triagonal interface includes defined 90 degree angles in said complementary ridges and grooves.

* * * * *